US010030552B2

(12) United States Patent
Liao et al.

(10) Patent No.: US 10,030,552 B2
(45) Date of Patent: Jul. 24, 2018

(54) OIL SUCTION DEVICE

(71) Applicants: Ying-Chieh Liao, Taichung (TW); Yu-Kuo Liao, Taichung (TW)

(72) Inventors: Ying-Chieh Liao, Taichung (TW); Yu-Kuo Liao, Taichung (TW)

( * ) Notice: Subject to any disclaimer, the term of this patent is extended or adjusted under 35 U.S.C. 154(b) by 56 days.

(21) Appl. No.: 15/240,440

(22) Filed: Aug. 18, 2016

(65) Prior Publication Data

US 2018/0051603 A1 Feb. 22, 2018

(51) Int. Cl.

| | |
|---|---|
| ***B65B 31/04*** | (2006.01) |
| ***F01M 11/04*** | (2006.01) |
| ***B67D 7/04*** | (2010.01) |
| ***B65D 83/00*** | (2006.01) |

(52) U.S. Cl.
CPC ..... *F01M 11/04* (2013.01); *B65D 83/0033* (2013.01); *B67D 7/04* (2013.01)

(58) Field of Classification Search
CPC ..... F01M 11/04; B65D 83/0033; B67D 7/04
USPC ..... 141/65
See application file for complete search history.

(56) References Cited

U.S. PATENT DOCUMENTS 6,463,952 B1 * 10/2002 Stevens ..... B65D 25/42 137/205

* cited by examiner

*Primary Examiner* — Jason K Niesz
(74) *Attorney, Agent, or Firm* — Muncy, Geissler, Olds & Lowe, P.C.

(57) ABSTRACT

An oil suction device is provided, including a main body and a sleeve member. A front end of the main body has a flow hole, an interior of the main body has a receiving space, one of two ends of a piston member is disposed in the receiving space and movable relative to the main body to allow a fluid to flow into or out of the receiving space through the flow hole, and the main body is light-penetrable. The sleeve member covers the main body, the sleeve member has at least one hollow-out portion formed radially, and the sleeve member and the main body are in different colors.

7 Claims, 4 Drawing Sheets

OIL SUCTION DEVICE

BACKGROUND OF THE INVENTION

Field of the Invention

The present invention relates to a suction device, and more particularly to an oil suction device.

Description of the Prior Art

In a common way of refilling oil for a vehicle, a user opens an oil tank of the vehicle and grips an oil-refilling device to inject an oil (for example, an engine oil or a brake oil) into the oil tank so as to replenish a proper amount of the oil. The conventional oil-refilling device includes a tube body and a piston member, the tube body is made of metal and can receive the oil, and the piston member is movable relative to the tube body to push the oil so that the user can operate the piston member to inject the oil through the tube body into the oil tank.

However, when refilling the oil, the tube body is contaminated by the oil, a smooth surface of the tube body make it hard for the user to grip the tube body which is contaminated by the oil firmly, so the oil-refilling device may fall off, the oil may spill out, or dirt may enter the tube body and contaminate the oil. In addition, because the vehicle has a complex structure, different types of the oil need to be added thereinto. Therefore, the user needs to prepare a plurality of the conventional oil-refilling devices for receiving different types of the oil, and it is hard for the user to distinguish the type of the oil in each said oil-refilling device, and the user may mistake the oil and add a wrong type of the oil into the oil tank.

The present invention has arisen to mitigate and/or obviate the afore-described disadvantages.

SUMMARY OF THE INVENTION

The major object of the present invention is to provide an oil suction device, the oil suction device is anti-slippery and can prevent the oil suction device from falling off from a user's gripping after an outer surface of the oil suction device is contaminate by oil.

To achieve the above and other objects, an oil suction device is provided, including a main body and a sleeve member. A front end of the main body has a flow hole, an interior of the main body has a receiving space, one of two ends of a piston member is disposed in the receiving space and movable relative to the main body to allow a fluid to flow into or out of the receiving space through the flow hole, and the main body is light-penetrable. The sleeve member covers the main body, the sleeve member has at least one hollow-out portion formed radially, and the sleeve member and the main body are in different colors.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Figure 1:
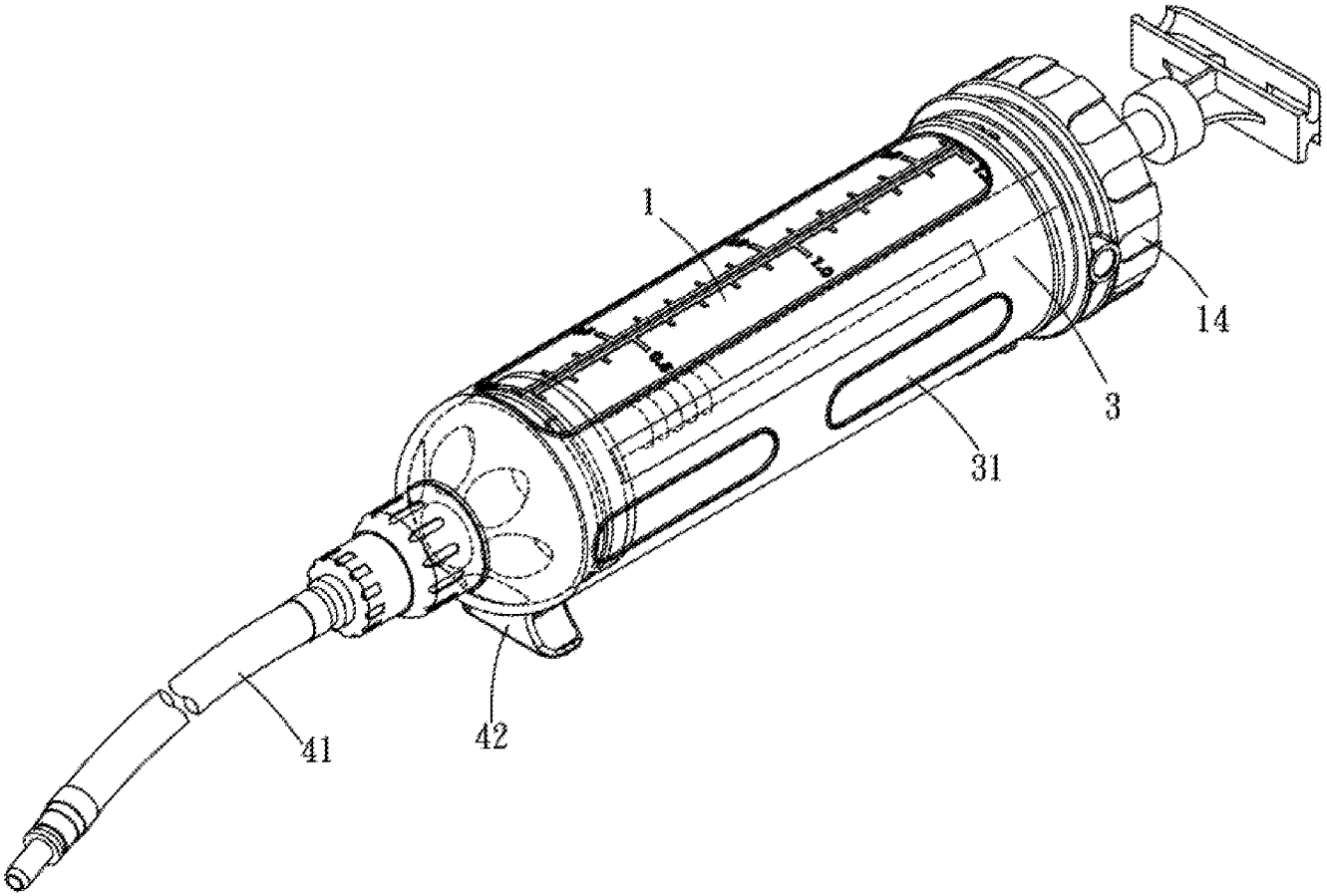
FIGS. 1 and 2 are stereograms of a preferred embodiment of the present invention.
Figure 2:
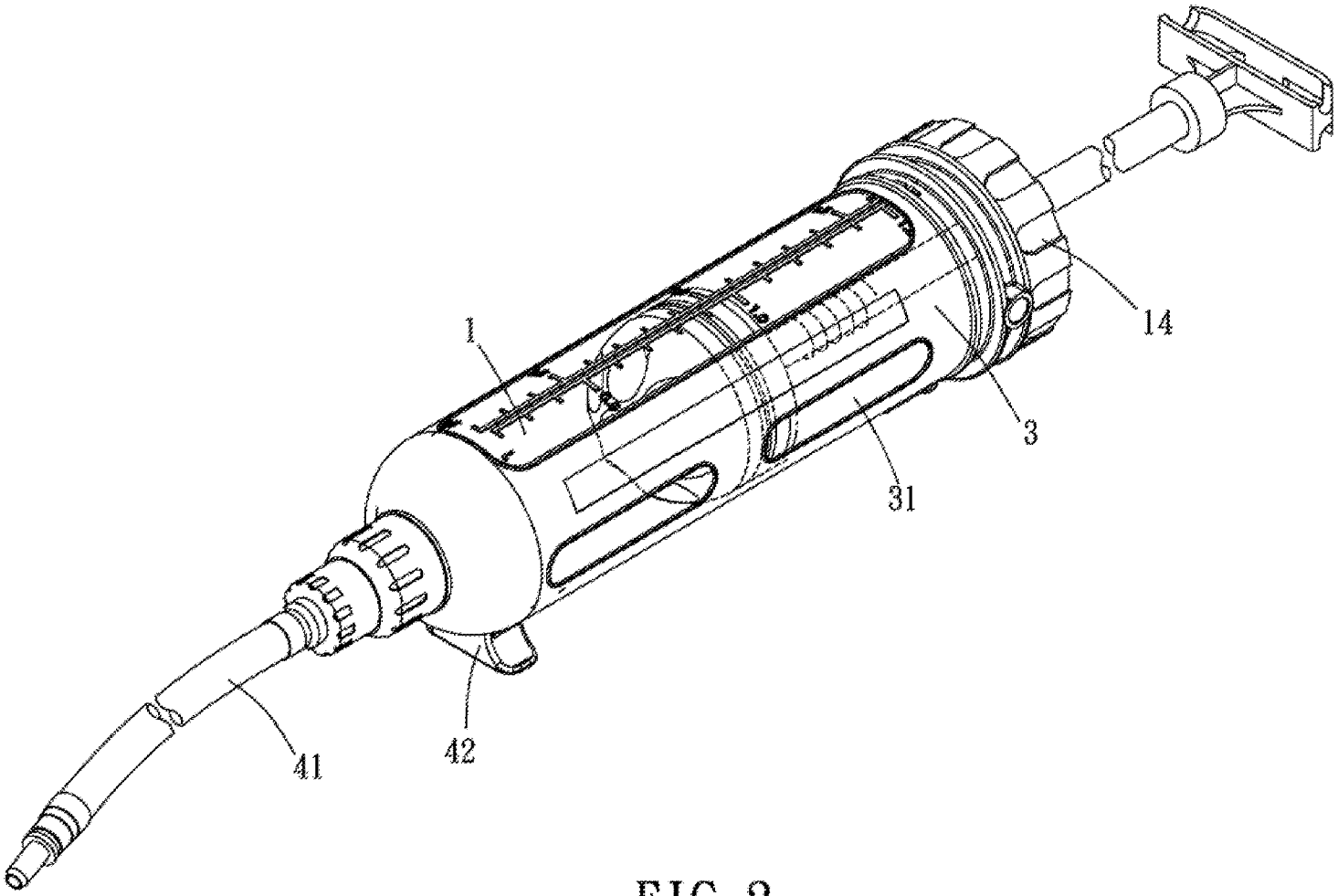
Figure 3:
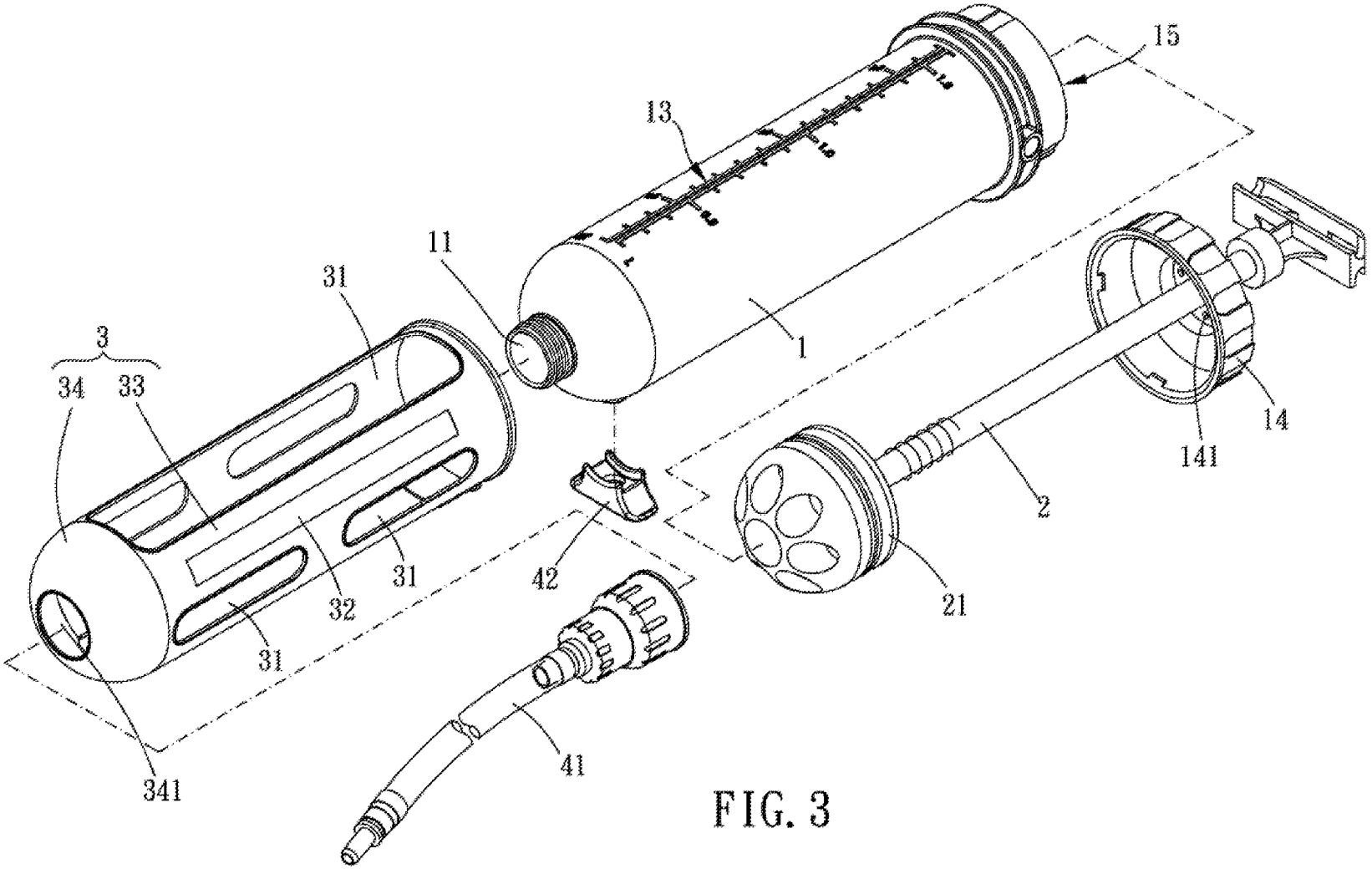
FIG. 3 is a breakdown view of the preferred embodiment of the present invention.
Figure 4:
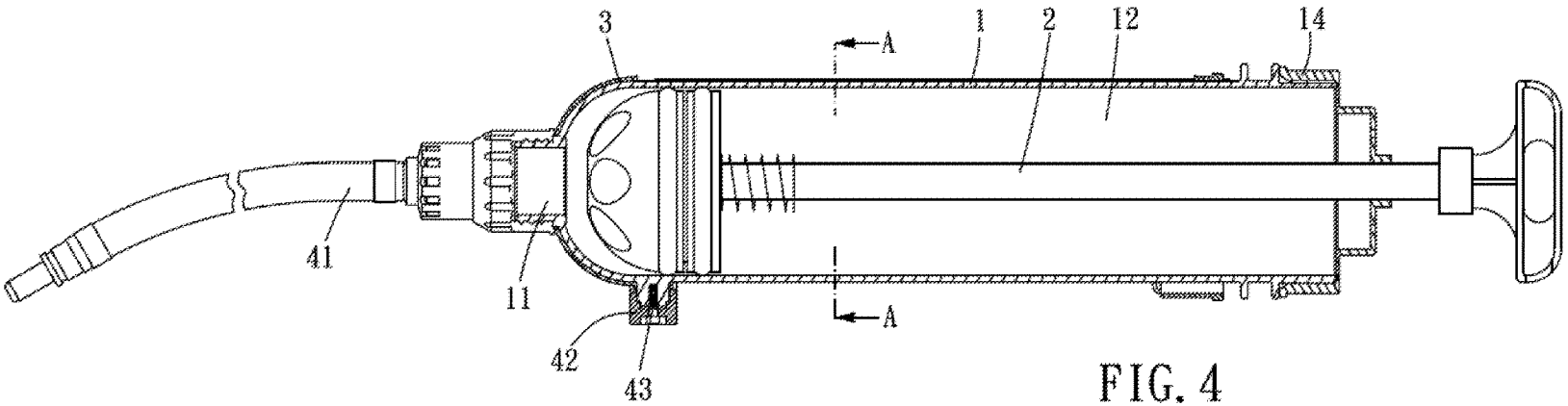
FIG. 4 is a cross-sectional view of the preferred embodiment of the present invention.
Figure 5:
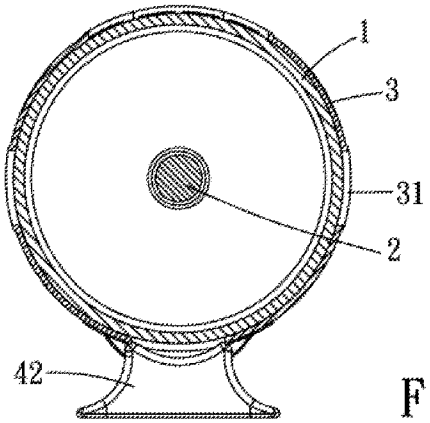
FIG. 5 is a cross-sectional view, taken along line A-A of FIG. 4.

Please refer to FIGS. 1 to 5 for a preferred embodiment of the present invention. An oil suction device includes a main body 1 and a sleeve member 3.

A front end of the main body 1 has a flow hole 11, an interior of the main body 1 has a receiving space 12, and one of two ends of a piston member 2 is disposed in the receiving space 12 and movable relative to the main body 1 to allow a fluid (in this embodiment, the fluid is an oil) to flow into or out of the receiving space 12 through the flow hole 11. The main body 1 is further assembled to a tube member 41 which is bendable and corresponds to the flow hole 11, and one of two ends of the tube member 41 remote from the main body 1 is inserted in an oil tank (not shown) so that the fluid can flow into or out of the receiving space 12 of the main body 1 through the tube member 41.

The sleeve member 3 covers the main body 1, the sleeve member 3 has at least one hollow-out portion 31 formed radially, and in this embodiment, there is a plurality of hollow-out portions 31. It is to be noted that the main body 1 is light-penetrable, and the sleeve member 3 and the main body 1 are in different colors. A user can use different colors of the sleeve members 3 of the oil suction device based on different types of oil so as to quickly distinguish the oil in each said oil suction device.

Preferably, the main body 1 may further have an indicator portion 13, the indicator portion 13 is for correspondingly indicating a receiving amount of the flow in the interior of the main body 1, and a contour of one of the hollow-out portions 31 of the sleeve member 3 corresponds to that of the indicator portion 13; therefore, the user can observe the main body 1 which is light-penetrable and the indicator portion 13 to know exactly a remaining oil in the receiving space 12 of the main body 1 so as to decide an amount of oil to be refilled into the main body 1 before refilling the oil or to remove the main body 1 after the oil is injected into the oil tank so that the oil will not spill out of the main body 1 and cause waste or contamination.

Specifically, preferably, the hollow-out portions 31 are arranged along a longitudinal direction of the main body 1. More specifically, at least two of the hollow-out portions 31 are arranged along a longitudinal direction of the main body 1, and in this embodiment, two of the hollow-out portions 31 are arranged along a longitudinal direction of the main body 1 so that it is convenient for the user to grip on of either one of two ends of the sleeve member 3 and the main body 1. The hollow-out portions 31 is anti-slippery so as to prevent the sleeve member 3 and the main body 1 from slipping off from hands of the user when the sleeve member 3 and the main body 1 are contaminated by the oil, and the hollow-out portions 31 can largely decrease a weight and materials needed of the sleeve member 3.

Specifically, in this embodiment, the sleeve member 3 and the main body 1 are respectively formed through injection molding, and the sleeve member 3 is additionally detachably attached onto the main body 1, so the sleeve member 3 can be disassembled to be cleaned. In other embodiments, the sleeve member 3 may be molded directly on the main body 1 through injection molding, and this type of manufacturing process is simpler and more cost-saving.

Specifically, preferably, the sleeve member 3 is made of plastic, a thickness of the sleeve member 3 is between 0.5 mm and 2 mm, and in this embodiment, the thickness of the sleeve member 3 is 1 mm. Furthermore, in this embodiment, the sleeve member 3 includes a main body portion 33 and a hemispherical portion 34, the main body portion 33 and the hemispherical portion 34 are integrally formed, the main body portion 33 is cylindrical, and the hemispherical portion 34 has a through hole 341 corresponding to the flow hole 11.

More specifically, a oil sealing ring 21 (for example, an 0 ring) which abuts against an inner wall of the receiving space 12 is sleeved on an outer periphery of an end portion of the piston member 2, the main body 1 has at least one air hole 141 arranged between the oil sealing ring 21 and an end portion of the main body 1, the at least one air hole 141 is for adjusting an air pressure in the receiving space 12, in this embodiment, there is a plurality of air holes 141 so that the piston member 2 can move relative to the main body 1, the oil sealing ring 21 can abut against an inner wall surface of the main body 1 tightly, and an outer side of the oil sealing ring 21 flexibly abuts against the inner wall surface of the main body 1 so as to decrease an abrasion between the oil sealing ring and the inner wall surface of the main body 1 and to elevate a sealability.

In this embodiment, one of two ends of the main body 1 has an opening 15 which communicates with the receiving space 12, the opening 15 is for the fluid to flow therethrough, a cover body 14 is assembled to the main body 1 to close the opening 15, the piston member 2 is disposed through the cover body 14, and the air holes 141 are arranged on the cover body 14.

Preferably, an outer periphery of the sleeve member 3 has a frame body 42, the frame body 42 is for supporting the main body 1 and the sleeve member 3, a fastening member 43 fixes the main body 1, the sleeve member 3 and the frame body 42 together, and in other embodiments, the frame body may be fixed to the sleeve member 3 through engagement.

In addition, an outer peripheral wall of the sleeve member 3 has at least one recessed portion 32 extending along a longitudinal direction of the main body 1. In this embodiment, there are two said recessed portions 32 to elevate an anti-slippery effect, and each said recessed portion 32 is rectangular (in other embodiments, each said recessed portion may be in other shapes).

Given the above, in the oil suction device, the hollow-out portions make it convenient for the user to grip the sleeve member and the main body, the hollow-out portions are anti-slippery to prevent the sleeve member and the main body from slipping off from the user's hands due to oil contamination, and the hollow-out portions help to decrease the weight and cost on materials of the sleeve member.

Furthermore, the main body is light-penetrable, and the sleeve member and the main body are in different colors so that the user can use different colors of the sleeve members 3 of the oil suction device based on different types of oil so as to quickly distinguish the oil in each said oil suction device.

While we have shown and described various embodiments in accordance with the present invention, it should be clear to those skilled in the art that further embodiments may be made without departing from the scope of the present invention.

What is claimed is:

1. An oil suction device, including:

a main body, a front end of the main body having a flow hole, an interior of the main body having a receiving space, one of two ends of a piston member being disposed in the receiving space and movable relative to the main body to allow a fluid to flow into or out of the receiving space through the flow hole, the main body being light-penetrable;

a sleeve member, covering the main body, the sleeve member having at least one hollow-out portion formed radially, the sleeve member and the main body being in different colors;

wherein the main body has an indicator portion, the indicator portion is for correspondingly indicating a receiving amount of the flow in the interior of the main body, and a contour of one of the hollow-out portions of the sleeve member corresponds to that of the indicator portion.

2. The oil suction device of claim 1, wherein the sleeve member includes a plurality of the hollow-out portions, and at least two of the hollow-out portions are arranged along a longitudinal direction of the main body.

3. The oil suction device of claim 1, wherein the sleeve member and the main body are respectively formed through injection molding, and the sleeve member is additionally detachably attached onto the main body.

4. The oil suction device of claim 1, wherein the sleeve member is molded directly on the main body through injection molding.

5. An oil suction device, including:

a main body, a front end of the main body having a flow hole, an interior of the main body having a receiving space, one of two ends of a piston member being disposed in the receiving space and movable relative to the main body to allow a fluid to flow into or out of the receiving space through the flow hole, the main body being light-penetrable;

a sleeve member, covering the main body, the sleeve member having at least one hollow-out portion formed radially, the sleeve member and the main body being in different colors;

wherein the sleeve member includes a main body portion and a hemispherical portion, the main body portion and the hemispherical portion are integrally formed, the main body portion is cylindrical, and the hemispherical portion has a through hole corresponding to the flow hole.

6. The oil suction device of claim 1, wherein the sleeve member is made of plastic, and a thickness of the sleeve member is between 0.5 mm and 2 mm.

7. An oil suction device, including:

a main body, a front end of the main body having a flow hole, an interior of the main body having a receiving space, one of two ends of a piston member being disposed in the receiving space and movable relative to the main body to allow a fluid to flow into or out of the receiving space through the flow hole, the main body being light-penetrable;

a sleeve member, covering the main body, the sleeve member having at least one hollow-out portion formed radially, the sleeve member and the main body being in different colors;

wherein an outer peripheral wall of the sleeve member has at least one recessed portion extending along a longitudinal direction of the main body;

wherein the main body has an indicator portion, the indicator portion is for correspondingly indicating a receiving amount of the flow in the interior of the main body, and a contour of one of the hollow-out portions of the sleeve member corresponds to that of the indicator portion; the sleeve member includes a plurality of the hollow-out portions, and at least two of the hollow-out portions are arranged along a longitudinal direction of the main body; the sleeve member and the main body are respectively formed through injection molding, and the sleeve member is additionally detachably attached onto the main body.

* * * * *